US005792285A

United States Patent [19]

Miyazaki et al.

[11] Patent Number: 5,792,285

[45] Date of Patent: Aug. 11, 1998

[54] HOT-ROLLED FERRITIC STEEL FOR MOTOR VEHICLE EXHAUST MEMBERS

[75] Inventors: Atsushi Miyazaki; Takeshi Yokota; Fusao Togashi, all of Chiba, Japan

[73] Assignee: Kawasaki Steel Corporation, Japan

[21] Appl. No.: 674,287

[22] Filed: Jul. 2, 1996

Related U.S. Application Data

[63] Continuation of Ser. No. 425,782, Apr. 20, 1995, abandoned.

[30] Foreign Application Priority Data

Apr. 21, 1994 [JP] Japan ..... 6-105917

[51] Int. Cl.[6] ..... C22C 38/26

[52] U.S. Cl. ..... 148/325; 148/333

[58] Field of Search ..... 148/325, 333; 420/42, 110, 69

[56] References Cited

U.S. PATENT DOCUMENTS

| | | | |
|---|---|---|---|
| 3,650,731 | 3/1972 | Aggen . | |
| 4,286,986 | 9/1981 | Borneman . | |
| 4,331,474 | 5/1982 | Espy . | |
| 5,302,214 | 4/1994 | Uematsu et al. | 148/325 |
| 5,427,634 | 6/1995 | Fujita et al. | 148/325 |

FOREIGN PATENT DOCUMENTS

| | | |
|---|---|---|
| 0 049 033 | 4/1982 | European Pat. Off. . |
| 0 225 263 | 6/1987 | European Pat. Off. . |

*Primary Examiner*—Deborah Yee
*Attorney, Agent, or Firm*—Austin R. Miller

[57] ABSTRACT

A hot-rolled ferrite steel capable of being used in a hot-rolled annealed condition as a material for a motor vehicle exhaust system including:

about 0.02 wt % or less of C,
about 0.8 wt % or less of Mn,
about 0.015 wt % or less of N,
about 0.02 wt % or less of Al,
about 0.02 wt % or less of Ti,
about 0.02 wt % or less of Zr; the steel further including:
about 0.4 to 2 wt % of Si,
about 6 to 17 wt % of Cr,
about 0.025 to 0.10 wt % of P,
about 0.35 to 0.60 wt % of Nb; and
the balance Fe and incidental impurities.

The weight percentages of the above components satisfy the following equations (1) and (2):

$$Nb/(C+N) \geqq 13 \quad (1)$$

$$11 \leqq Cr+3Si+4Nb-50(C+N+P)-Mn-Ni-Co+Mo+Cu \leqq 16.5 \quad (2),$$

such that a low-cost ferritic steel is produced which, after conventional hot rolling, exhibits characteristics well-suited for motor vehicle exhaust systems such as high workability, high heat resistance and good manufacturability.

20 Claims, 5 Drawing Sheets
(1 of 5 Drawing(s) in Color)

STRUCTURE ALONG ROLLING DIRECTION AFTER HOT ROLLING AND ANNEALING (x100)

A; STEEL OF THE INVENTION A (14.8Cr-0.48Nb)

B; SUH409L (11.3Cr-0.25Ti)

EXAMPLE OF SOLIDIFICATION CRACK IN TIG-WELDED PORTION COMPARATIVE EXAMPLE STEEL 20 (0.66Nb-0.025N)

HOT-ROLLED FERRITIC STEEL FOR MOTOR VEHICLE EXHAUST MEMBERS

This application is a continuation of application Ser. No. 08/425,782, filed Apr. 20, 1995, now abandoned.

BACKGROUND OF THE INVENTION

1. Field of the Invention

This invention relates to a material for forming members in a motor vehicle exhaust system and, more particularly, to a ferritic steel which can be used in a hot-rolled annealed condition as a material for forming an exhaust manifold, an exhaust pipe, a catalytic converter shell or the like.

2. Description of the Related Art

Conventionally, nodular graphite cast iron and aluminum-plated plain steel have been used as materials for forming an exhaust manifold, an exhaust pipe, a catalytic converter shell and the like in motor vehicle exhaust systems. Recently, motor vehicle engines have been designed so as to optimize the air-fuel ratio to reduce fuel consumption, improve exhaust gas purification and increase output. As a result, the temperature of engine exhaust gas has been increased to 800° C. or higher. Under such conditions, the above-mentioned conventional materials are unsatisfactory in terms of oxidation resistance, high-temperature proof stress and other high-temperature characteristics. Therefore, stainless steel, chiefly SUH409L stainless steel, is now replacing the above-mentioned materials.

In a motor vehicle, an exhaust manifold made of nodular graphite cast iron and having a thickness of 5 mm or more may be replaced with a manifold made of stainless steel and having a thickness of about 1.5 to 2.5 mm. The weight of the latter is only a fraction of that of the former. The improved fuel economy achieved by such a reduction in the total weight of the motor vehicle is significant.

Further, a thin stainless steel manifold has a small heat capacity and can therefore limit the reduction in the exhaust temperature. Maintaining high exhaust temperatures helps quickly activate catalysts for removing NOx and other compounds in exhaust gas, thereby greatly improving exhaust gas purification effects.

As described above, stainless steel is an excellent material for motor vehicle exhaust systems, but the use of stainless steel exhaust manifolds and pipes is limited to certain kinds of motor vehicles for reasons described below.

(1) High Manufacturing Cost

The price of stainless steel is high compared to cast iron and aluminum-plated plain steel.

While the degree of freedom in shaping cast iron is high, stainless steel needs a cold rolling and annealing process because it is worked by complicated bending and pressing operations, thereby further increasing the manufacturing cost.

It is well known that high workability can be obtained if the slab reheating temperature and the hot rolling starting temperature are lowered below the conventional temperature of about 1250° C. This method, however, increases wear on the hot rolling rollers and increases rolling load, i.e., increases the load on manufacturing equipment. As a result, the advantage of using stainless steel in a hot-rolled annealed state is offset by the increased manufacturing cost.

(2) Difficulty in Working

If a material for a motor vehicle exhaust system has excellent high-temperature proof stress, it can be formed into an exhaust member at a lesser thickness which contributes to weight reduction. A well-known method of adding Nb to ferritic stainless steel is ordinarily used as a means for improving the high-temperature proof stress of ferritic stainless steel. In such a case, it is important to minimize the deterioration in workability at room temperature while maintaining the high-temperature proof stress, and various techniques have been provided to achieve such an effect. However, it is believed that any prior art stainless steel in a hot-rolled annealed condition cannot be worked into a motor vehicle exhaust system member, and no practically-usable material of the above-described kind has been provided.

Various conventional materials for motor vehicle exhaust systems are disclosed in Japanese Patent Laid-Open Publication No. 74852/1992, Japanese Patent Laid-Open Publication No. 145359/1985 (U.S. Pat. No. 4,640,722), Japanese Patent Publication No. 41694/1989 (U.S. Pat. No. 4,286,986), Japanese Patent Laid-Open Publication No. 68448/1989 (U.S. Pat. No. 4,834,808), U.S. Pat. Nos. 4,417,921 and 3,997,373 and other documents. These documents specify use of materials as a cold-rolled annealed sheet, and are not intended to cover use as a hot-rolled sheet. In general, a cold-rolled annealed sheet has a hot-rolled structure destroyed by cold rolling. Accordingly, if the cold-rolled draft is sufficiently large, the workability of the hot-rolled annealed sheets is not a concern. The workability in a hot-rolled annealed condition of the materials disclosed in these documents is not satisfactory with respect to use as a motor vehicle exhaust system material.

Japanese Patent Laid-Open Publication No. 85960/1982 (U.S. Pat. No. 4,331,474), U.S. Pat. No. 3,650,731, and Japanese Patent Laid-Open Publication No. 232231/1992, for example, disclose ferritic stainless steel materials specified for use as a hot-rolled sheet. The performance of these materials, however, is not satisfactorily high with respect to use as a material for motor vehicle exhaust systems, as described below.

The material disclosed in Japanese Patent Laid-Open Publication No. 85960/1982 (U.S. Pat. No. 4,331,474) has a small elongation when formed as a hot-rolled sheet, as shown in Table II of the specification of that publication, and is not satisfactory in terms of workability with respect to use as a material for motor vehicle exhaust systems.

The materials disclosed in U.S. Pat. No. 3,650,731 and Japanese Patent Laid-Open Publication No. 232231/1992 are characterized by setting the proportion of γ-phase to 50 to 100% at the time of finishing of hot rolling in order to improve the workability, toughness, or strength. Accordingly, if each of these materials is used to form a motor vehicle exhaust system member in which certain bending workability is required with respect to a welded portion, a martensite (α') phase in the welded portion is formed by being metamorphosed from γ-phase so that the bending workability is reduced, as shown in Table 4-1. A motor vehicle exhaust system undergoes cycles of heating to high temperatures and cooling to room temperatures. Under such cycling conditions, α'-phase would be metamorphosed into α- or γ-phase in the case where two phases of α+α' originally were present. The metamorphosed phase differs in the amount of thermal expansion or contraction relative to other portions, thus causing strain which may result in breaking.

TABLE 4-1

Relationship between Workability Parameter (Pa), Elongation of Hot-rolled Annealed Sheet and Workabiility of Welded Portion (Steel of the Invention)

| Symbol | C | N | Cr | Nb | Ti | Zr | Al | Si | Mn | Mo | Cu | P | Remarks (1) | Remarks (2) Pa | El (%) | Welded Portion (*3) Structure | Welded Portion (*2) Bendability |
|---|---|---|---|---|---|---|---|---|---|---|---|---|---|---|---|---|---|
| N | 0.005 | 0.004 | 6.2 | 0.45 | <0.02 | <0.02 | <0.02 | 1.55 | 0.35 | 2.03 | — | 0.043 | 50.0 | 11.73 | 34 | α | ○ |
| O | 0.003 | 0.004 | 6.3 | 0.51 | <0.02 | <0.02 | <0.02 | 1.94 | 0.31 | — | — | 0.044 | 72.9 | 11.30 | 34 | α | ○ |
| P | 0.007 | 0.011 | 9.5 | 0.43 | <0.02 | <0.02 | <0.02 | 1.03 | 0.35 | — | — | 0.040 | 30.0 | 11.50 | 36 | α | ○ |
| Q | 0.006 | 0.007 | 11.4 | 0.51 | <0.02 | <0.02 | <0.02 | 0.82 | 0.35 | 1.12 | — | 0.045 | 39.2 | 13.77 | 37 | α | ○ |
| R | 0.005 | 0.005 | 11.9 | 0.55 | <0.02 | <0.02 | <0.02 | 1.02 | 0.31 | 0.52 | — | 0.050 | 55.0 | 14.37 | 38 | α | ○ |
| I | 0.013 | 0.009 | 14.5 | 0.48 | <0.02 | <0.02 | <0.02 | 0.84 | 0.49 | — | — | 0.042 | 21.8 | 15.25 | 37 | α | ○ |
| S | 0.010 | 0.011 | 15.7 | 0.48 | <0.02 | <0.02 | <0.02 | 0.61 | 0.40 | 0.51 | — | 0.041 | 22.9 | 16.46 | 34 | α | ○ |
| T | 0.006 | 0.008 | 11.5 | 0.51 | <0.02 | <0.02 | <0.02 | 0.85 | 0.04 | — | — | 0.051 | 36.4 | 12.80 | 39 | α | ○ |
| V | 0.011 | 0.013 | 15.7 | 0.48 | <0.02 | <0.02 | <0.02 | 0.67 | 0.40 | — | 0.31 | 0.061 | 20.0 | 15.29 | 39 | α | ○ |
| Z | 0.013 | 0.010 | 11.4 | 0.42 | <0.02 | <0.02 | <0.02 | 0.81 | 0.05 | 0.51 | 0.31 | 0.051 | 18.3 | 12.68 | 37 | α | ○ |

*Out of Claimed Range
(*1) Welding Condition (TIG) . . . V = 600 mm/min
I = 200 A
One Side Ar-Sealed 15l/min
(*2) ○ . . . Not cracked
x . . . Cracked
(*3) α . . . Ferrite Structure
α' . . . Martensite Structure
(1) Nb/(C + N)
(2) Pa: Cr + 3Si + 4Nb − 50 (C + N + P) − Mn − Ni − Co + Mo + Cu

TABLE 4-2

Relationship between Workability Parameter (Pa), Elongation of Hot-rolled Annealed Sheet and Workabiility of Welded Portion (Comparative Example Steel

| Symbol | C | N | Cr | Nb | Ti | Zr | Al | Si | Mn | Mo | Cu | P | Remarks (1) | Remarks (2) Pa | El (%) | Welded Portion (*3) Structure | Welded Portion (*2) Bendability |
|---|---|---|---|---|---|---|---|---|---|---|---|---|---|---|---|---|---|
| 11 | 0.013 | 0.009 | 6.2 | 0.45 | <0.02 | <0.02 | <0.02 | 1.05 | 0.36 | — | — | 0.042 | 20.5 | 7.59* | — | α + α' | x |
| 12 | 0.004 | 0.005 | 9.4 | 0.48 | <0.02 | <0.02 | <0.02 | 0.63 | 0.35 | — | — | 0.041 | 21.8 | 10.36* | — | α + α' | x |
| 13 | 0.012 | 0.011 | 9.3 | 0.50 | <0.02 | <0.02 | <0.02 | 0.85 | 0.33 | 0.82 | — | 0.046 | 22.7 | 10.89* | — | α + α' | x |
| 14 | 0.002 | 0.003 | 14.3 | 0.55 | <0.02 | <0.02 | <0.02 | 0.83 | 0.35 | 0.51 | — | 0.031 | 110.0 | 17.35* | 33 | α | ○ |
| 15 | 0.006 | 0.007 | 15.9 | 0.45 | <0.02 | <0.02 | <0.02 | 1.50 | 0.33 | — | — | 0.050 | 34.6 | 18.72* | 31 | α | ○ |
| 16 | 0.035* | 0.013 | 14.3 | 0.45 | <0.02 | <0.02 | <0.02 | 0.81 | 0.35 | — | — | 0.042 | 9.4* | 13.68 | 32 | α | ○ |
| 17 | 0.012 | 0.009 | 15.3 | 0.42 | <0.02 | <0.02 | <0.02 | 0.91 | 0.93* | — | — | 0.041 | 20.0 | 15.68 | 32 | α | ○ |
| 18 | 0.007 | 0.005 | 6.5 | 0.51 | <0.02 | <0.02 | <0.02 | 2.31* | 0.73 | — | — | 0.041 | 42.5 | 12.09 | 33 | α | ○ |

*Out of Claimed Range
(*1) Welding Condition (TIG) . . . V = 600 mm/min
I = 200 A
One Side Ar-Sealed 15l/min
(*2) ○ . . . Not cracked
x . . . Cracked
(*3) α . . . Ferrite Structure
α' . . . Martensite Structure
(1) Nb/(C + N)
(2) Pa: Cr + 3Si + 4Nb − 50 (C + N+ P) − Mn − Ni − Co + Mo + Cu As described above, none of the existing low-priced materials can be used in a conventionally hot-rolled annealed condition as a motor vehicle exhaust system member because they fail to achieve both the desired high-temperature characteristics and the desired workability. A material satisfying the above-described requirements would be effective in reducing fuel consumption, improving exhaust gas purification and improving engine performance, and thus would be very useful.

SUMMARY OF THE INVENTION

An object of the present invention is to provide a low-priced hot-rolled ferritic steel which has high-temperature characteristics necessary for forming a motor vehicle exhaust system member, i.e., high-temperature proof stress, oxidation resistance and high-temperature salt damage resistance, and in which high workability at room temperature can be maintained even if a conventional manufacturing process is used.

We have discovered that a hot-rolled ferritic steel which can be manufactured by ordinary hot rolling and annealing processes can be obtained only when the contents of various elements, including Nb and P, are controlled within particular ranges.

According to one aspect of the invention, there is provided a hot-rolled ferritic steel for a motor vehicle exhaust system having:

about 0.4 to 2 wt % of Si, about 6 to 17 wt % of Cr, about 0.025 to 0.10 wt % of P, and about 0.35 to 0.60 wt % of Nb, which are indispensable alloy elements;

about 0.02 wt % or less of C, about 0.8 wt % or less of Mn, about 0.015 wt % or less of N, about 0.02 wt % or less of Al, about 0.02 wt % or less of Ti, and about 0.02 wt % or less of Zr, which are impurity elements; and the balance Fe and incidental impurities, wherein the weight percentages of the above components satisfy the following equations (1) and (2):

$$Nb/(C+N) \geqq 13 \quad (1)$$

$$11 \leqq Cr+3Si+4Nb-50(C+N+P)-Mn-Ni-Co+Mo+Cu \leqq 16.5 \quad (2).$$

According to another aspect of the invention, there is provided a hot-rolled ferritic steel for a motor vehicle exhaust system having:

about 0.4 to 2 wt % of Si, about 6 to 17 wt % of Cr, about 0.025 to 0.10 wt % of P, and about 0.35 to 0.60 wt % of Nb, which are indispensable alloy elements;

about 0.02 wt % or less of C, about 0.8 wt % or less of Mn, about 0.015 wt % or less of N, about 0.02 wt % or less of Al, about 0.02 wt % or less of Ti, and about 0.02 wt % or less of Zr, which are impurity elements;

at least one of about 0.1 to 3.0 wt % of Mo, and about 0.1 to 1.0 wt % of Cu, which are other preferred alloy elements; and the balance Fe and incidental impurities, wherein the weight percentages of the above components satisfy the following equations (1) and (2):

$$Nb/(C+N) \geqq 13 \quad (1)$$

$$11 \leqq Cr+3Si+4Nb-50(C+N+P)-Mn-Ni-Co+Mo+Cu \leqq 16.5 \quad (2).$$

According to still another aspect of the invention, there is provided a hot-rolled ferritic steel for a motor vehicle exhaust system having:

about 0.4 to 2 wt % of Si, about 6 to 17 wt % of Cr, about 0.025 to 0.10 wt % of P, and about 0.35 to 0.60 wt % of Nb, which are indispensable alloy elements;

about 0.02 wt % or less of C, about 0.8 wt % or less of Mn, about 0.015 wt % or less of N, about 0.02 wt % or less of Al, about 0.02 wt % or less of Ti, and about 0.02 wt % or less of Zr, which are impurity elements;

at least one of about 1 wt % or less of Ni, and about 0.5 wt % or less of Co, which are other preferred alloy elements; and the balance Fe and incidental impurities, wherein the weight percentages of the above components satisfy the following equations (1) and (2):

$$Nb/(C+N) \geqq 13 \quad (1)$$

$$11 \leqq Cr+3Si+4Nb-50(C+N+P)-Mn-Ni-Co+Mo+Cu \leqq 16.5 \quad (2).$$

According to a further aspect of the invention, there is provided a hot-rolled ferritic steel for a motor vehicle exhaust system having:

about 0.4 to 2 wt % of Si, about 6 to 17 wt % of Cr, about 0.025 to 0.10 wt % of P, and about 0.35 to 0.60 wt % of Nb, which are indispensable alloy elements;

about 0.02 wt % or less of C, about 0.8 wt % or less of Mn, about 0.015 wt % or less of N, about 0.02 wt % or less of Al, about 0.02 wt % or less of Ti, and about 0.02 wt % or less of Zr, which are impurity elements;

at least one of about 0.1 to 3.0 wt % of Mo and about 0.1 to 1.0 wt % of Cu, and at least one of about 1 wt % or less of Ni and about 0.5 wt % or less of Co, which are other preferred alloy elements; and the balance Fe and incidental impurities, wherein the weight percentages of the above components satisfy the following equations (1) and (2):

$$Nb/(C+N) \geqq 13 \quad (1)$$

$$11 \leqq Cr+3Si+4Nb-50(C+N+P)-Mn-Ni-Co+Mo+Cu \leqq 16.5 \quad (2).$$

DESCRIPTION OF THE PREFERRED EMBODIMENT

Figure 1:
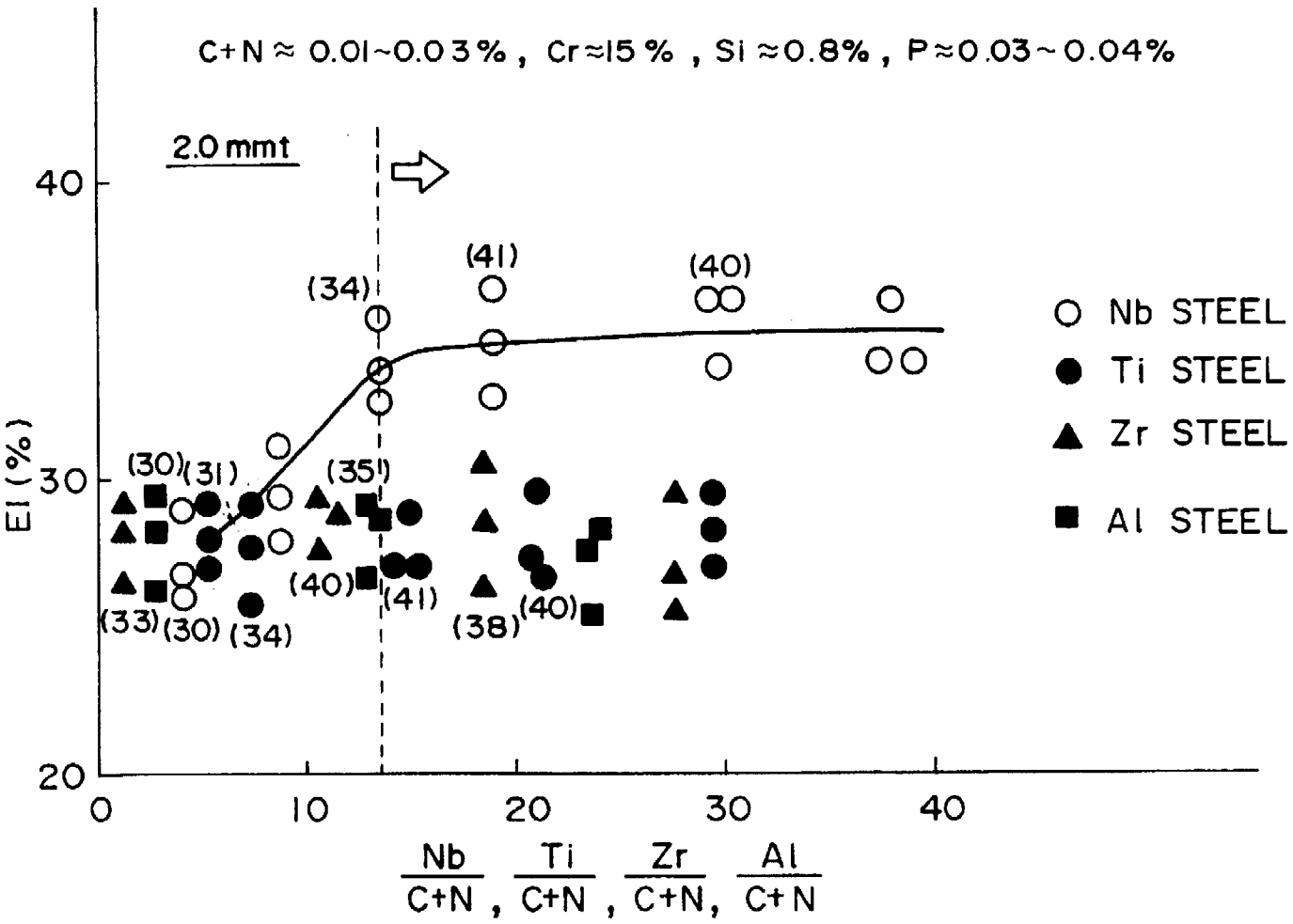
FIG. 1 is a graph showing the influence of Nb/(C+N), Ti/(C+N), Zr/(C+N) and Al/(C+N) upon the elongation of hot-rolled annealed sheets or cold-rolled annealed sheets.

As important characteristics for a motor vehicle exhaust system material, (A) workability, (B) high-temperature proof stress, high-temperature salt damage resistance, oxidation resistance, and (C) manufacturability must be considered. Criteria for evaluating characteristics (A), (B) and (C) and technical conceptions for achieving them will be described below in detail.

(A) A motor vehicle exhaust system material is not usually worked by deep drawing. It is worked mainly by bending, tube-expanding or the like, the effectiveness of which is influenced by the elongation of the material. Mechanical characteristics required for motor vehicle exhaust system materials were examined by considering elongation. It was discovered that, with respect to a steel sheet having a thickness of 2 mm, it is necessary that the breaking elongation be not less than about 34%, and that the yield stress (YS) be not greater than about 350 MPa because of power limitations of working equipment. According to the invention, the elongation and the YS of a hot-rolled sheet in an annealed condition are evaluated. The invention also comprises a case where a hot-rolled sheet is used to form a pipe which is thereafter annealed. In such a case, the strain caused when the material is formed into a pipe is also removed, so that higher workability is achieved compared to the formation of a pipe from a hot-rolled annealed sheet.

(B) Required high-temperature characteristics were determined by measurements described below.

The temperature of exhaust gas from present engines is about 800° C. at the highest. However, the maximum exhaust temperature tends to rise above 850° C. as fuel economy, exhaust gas purification, and output improve. Therefore, high-temperature proof stress was evaluated at 700° C. and 900° C., and oxidation resistance was evaluated when heating at 730° C., 830° C. and 930° C. for 200 hours.

High temperature salt damage is caused when splashing water or the like from road surfaces adheres to the motor vehicle exhaust system and is thereafter heated to a high temperature. Hot-rolled annealed sheets and cold-rolled annealed sheets differ from each other in surface properties or conditions, and a hot-rolled annealed sheet can be deteriorated by high-temperature salt damage. Therefore, high-temperature salt damage of hot-rolled annealed sheets at 700° C. were evaluated as well as that of a cold-rolled annealed sheet SUH409L.

(C) If in the process of manufacturing a hot-rolled annealed sheet the toughness of the sheet after hot rolling is not sufficiently high, brittle rupture of the hot-rolled sheet at the time of coiling can occur in cold temperatures. If such brittle rupture occurs, considerable retardation of the process results as well as a risk of injury to workers.

To avoid such brittle rupture, the Charpy absorbed energy at 0° C. of the hot-rolled sheet before annealing must be set to about 50 J/cm$^2$ or more.

The advantage of using a hot-rolled annealed sheet is reduced unless the hot-rolled annealed sheet is formed so as to have high workability and improved high-temperature characteristics by using the conventional hot rolling method, i.e., where the slab reheating temperature (SRT) is about 1250° C. (without inadvertently reducing the hot rolling temperature). An excellent material would provide (1) a sufficiently high toughness, processability with the conventional hot rolling process, and high workability; (2) a sufficiently high high-temperature proof stress as a hot-rolled annealed sheet; and (3) a sufficiently high oxidation resistance and an improved high-temperature salt damage resistance.

The inventors have discovered a remarkable material which satisfies (1) to (3), which will be described below.

(1) To obtain the workability necessary after annealing when the sheet is hot-rolled at about SRT 1250° C. to a thickness of 2 mm during conventional hot rolling, Nb/(C+N) must be set to 13 or more, as shown in FIG. 1. This may be because the recovery and recrystallization behaviors are retarded by a fine Nb precipitate precipitating at a high temperature so that a sufficiently large strain is created in the material during hot rolling. It is to be noted that no improvement in workability was observed with respect to other elements, i.e., Ti, Zr, Al, with which C and N are fixed, as also shown in FIG. 1. In general, addition of Ti, Zr, and Al is intended to improve the workability of cold-rolled annealed sheets. In the case of a hot-rolled annealed sheet, however, observed behaviors, as shown in FIG. 1, are very different. In FIG. 1, the elongation of each 2 mm thick cold-rolled annealed sheet obtained by cold rolling and annealed by setting the hot-rolled thickness to 5 mm is shown in parentheses. The elongation of each cold-rolled annealed sheet is improved with the increase in Nb/(C+N), Ti/(C+N), Zr/(C+N), or Al/(C+N), as is predicted from conventional knowledge.

Figure 3A:
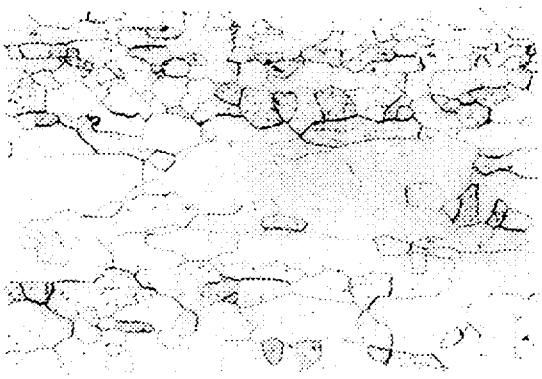
FIGS. 3A and 3B are photographic images of metallographic structures along the rolling direction after hot rolling and annealing.
Figure 3B:
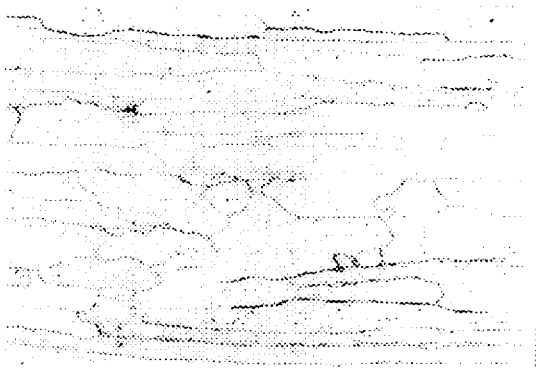

Table 1 shows the workability of hot-rolled annealed sheets obtained by adding Ti, Zr, and Al in combination to Nb-added steel. In each case, the workability is reduced in comparison with the steel to which Nb is singly added. Thus, it has been discovered that the workability of hot-rolled annealed sheets cannot be improved based on present knowledge about conventional cold-rolled annealed sheets, and that the workability of hot-rolled annealed sheets can be improved only when a steel composition is formed with strict separate addition of Nb. FIG. 3A and 3B show microstructures along the rolling direction of a hot-rolled annealed sheet of Nb/(C+N)=20.9 (Steel A (FIG. 3A)) and another hot-rolled annealed sheet of SUH409L (FIG. 3B) presently used. As can be seen in FIGS. 3A and 3B, grains of Steel A are much more uniform.

TABLE 1

Influence of Combined Addition of Ti, Zr and Al upon Elongation of Nb-added Hot-rolled Annealed Sheet

| Symbol | | C | N | Cr | Nb | Ti | Zr | Al | Si | Mn | P | Remark (1) | Remark (2) | El (%) |
|---|---|---|---|---|---|---|---|---|---|---|---|---|---|---|
| Steel of | A | 0.013 | 0.010 | 14.8 | 0.48 | 0.010 | 0.006 | 0.005 | 0.77 | 0.33 | 0.031 | 20.9 | 16.00 | 36 |
| the | B | 0.010 | 0.013 | 14.5 | 0.41 | 0.004 | <0.004 | 0.004 | 0.85 | 0.35 | 0.033 | 17.8 | 15.54 | 36 |
| Invention | C | 0.009 | 0.011 | 15.2 | 0.43 | 0.009 | 0.009 | 0.019 | 0.81 | 0.33 | 0.035 | 21.5 | 16.27 | 35 |
| | Y | 0.009 | 0.014 | 14.8 | 0.49 | 0.004 | 0.007 | <0.004 | 0.80 | 0.30 | 0.036 | 24.5 | 15.91 | 38 |
| Comparative | 1 | 0.012 | 0.014 | 14.9 | 0.44 | 0.091* | 0.011 | 0.011 | 0.79 | 0.33 | 0.037 | 16.9 | 15.55 | 32 |
| Example | 2 | 0.012 | 0.012 | 15.2 | 0.47 | 0.16* | 0.009 | 0.009 | 0.83 | 0.35 | 0.031 | 19.6 | 16.47 | 31 |
| Steel | 3 | 0.010 | 0.011 | 15.1 | 0.48 | 0.019* | 0.031* | 0.011 | 0.85 | 0.33 | 0.035 | 22.9 | 16.44 | 32 |

TABLE 1-continued

Influence of Combined Addition of Ti, Zr and Al upon Elongation of Nb-added Hot-rolled Annealed Sheet

| Symbol | | C | N | Cr | Nb | Ti | Zr | Al | Si | Mn | P | Remark (1) | Remark (2) | El (%) |
|---|---|---|---|---|---|---|---|---|---|---|---|---|---|---|
| | 4 | 0.013 | 0.012 | 14.9 | 0.51 | 0.007 | 0.011 | 0.07* | 0.85 | 0.35 | 0.033 | 20.4 | 16.24 | 32 |
| | 5 | 0.008 | 0.009 | 14.7 | 0.40 | 0.011 | 0.33* | 0.009 | 0.83 | 0.36 | 0.033 | 23.50 | 15.93 | 32 |
| SUH409L | | 0.006 | 0.007 | 11.3 | —* | 0.25* | — | — | 0.35 | 0.51 | 0.023 | —* | 10.04* | 32 |

*Out of Claimed Range
(1) Nb/(C + N)
(2) Cr + 3Si + 4Nb − 50 (C + N + P) − Mn− Ni − Co + Mo + Cu Table 2 shows changes in Charpy absorbed energy (at 0° C.) of hot-rolled sheets of steels differing in Nb content before annealing. It can be seen that brittleness sharply increases and workability deteriorates when the absolute amount of Nb exceeds 0.6%.

TABLE 2

Influence of Nb upon Toughness of Non-annealed Hot-rolled Sheet, Elongation of Hot-rolled Annealed Sheet and YS

| Symbol | | C | N | Cr | Nb | Ti | Zr | Al | Si | Mn | P | Remark (1) | Remark (2) | E(J/cm²) at 0° C. | El (%) | YS (MPa) |
|---|---|---|---|---|---|---|---|---|---|---|---|---|---|---|---|---|
| Steel of the Invention | D | 0.011 | 0.013 | 14.0 | 0.42 | <0.02 | <0.02 | <0.02 | 0.85 | 0.05 | 0.033 | 17.5 | 15.33 | 203 | 37 | 273 |
| | B | 0.010 | 0.013 | 14.5 | 0.41 | <0.02 | <0.02 | <0.02 | 0.85 | 0.35 | 0.033 | 17.8 | 15.54 | 185 | 36 | 294 |
| | E | 0.005 | 0.007 | 14.3 | 0.48 | <0.02 | <0.02 | <0.02 | 0.83 | 0.32 | 0.029 | 40.0 | 16.34 | 183 | 35 | 305 |
| | F | 0.006 | 0.005 | 14.8 | 0.57 | <0.02 | <0.02 | <0.02 | 0.81 | 0.61 | 0.041 | 51.8 | 16.30 | 141 | 37 | 318 |
| | G | 0.015 | 0.013 | 15.2 | 0.55 | <0.02 | <0.02 | <0.02 | 0.79 | 0.65 | 0.031 | 19.6 | 16.17 | 123 | 37 | 313 |
| Comparative Example Steel | 6 | 0.005 | 0.005 | 14.2 | 0.69* | <0.02 | <0.02 | <0.02 | 0.75 | 0.60 | 0.031 | 69.0 | 16.56* | 33 | 34 | 336 |
| | 7 | 0.019 | 0.010 | 14.3 | 0.72* | <0.02 | <0.02 | <0.02 | 0.83 | 0.55 | 0.029 | 24.8 | 16.22 | 39 | 35 | 339 |
| | 8 | 0.002 | 0.003 | 14.2 | 0.91* | <0.02 | <0.02 | <0.02 | 0.83 | 0.51 | 0.033 | 182.0 | 17.92* | 14 | 32 | 345 |
| | 9 | 0.015 | 0.013 | 14.5 | 0.93* | <0.02 | <0.02 | <0.02 | 0.79 | 0.78 | 0.031 | 33.1 | 16.86* | 14 | 33 | 350 |
| SUH409L | | 0.006 | 0.007 | 11.3 | —* | 0.25* | — | — | 0.35 | 0.51 | 0.023 | —* | 10.04* | 280 | 29 | 235 |

*Out of Claimed Range
(1) Nb/(C + N)
(2) Cr + 3Si + 4Nb − 50 (C + N + P) − Mn − Ni − Co + Mo + Cu The important effect of P will now be described. Conventionally, P is regarded as an incidental impurity. In some of the conventional materials, the amount of P is reduced to 0.02% or less. However, it was found that a reduction in P content causes a deterioration in the workability of hot-rolled annealed sheets. Consequently, it is possible to improve the workability of hot-rolled annealed sheets by adding an appropriate amount of P. This discovery implies that manufacturing costs can be reduced by simplifying the process step for removing P. The elongation and toughness of steels were measured while changing the content of P. and the results of these measurements are shown in Table 3. It was thereby found that even when the content of P was increased above the value in accordance with the Japanese Industrial Standard (JIS) G4304, for example, to 0.042 or 0.058%, no deterioration in workability was observed and the elongation was improved in comparison with a P level of 0.026% or 0.036% (Steel H, B), and that substantially no change was observed in yield stress.

TABLE 3

Influence of P upon Toughness of Non-annealed Hot-rolled Sheet, Elongation of Hot-rolled Annealed Sheet and YS

| Symbol | | C | N | Cr | Nb | Ti | Zr | Al | Si | Mn | P | Remark (1) | Remark (2) | E(J/cm²) at 0° C. | El (%) | YS (MPa) |
|---|---|---|---|---|---|---|---|---|---|---|---|---|---|---|---|---|
| Steel of the Invention | H | 0.007 | 0.011 | 14.1 | 0.45 | <0.02 | <0.02 | <0.02 | 0.80 | 0.55 | 0.026 | 25.0 | 15.55 | 185 | 35 | 294 |
| | B | 0.010 | 0.013 | 14.5 | 0.41 | <0.02 | <0.02 | <0.02 | 0.85 | 0.35 | 0.033 | 17.8 | 15.54 | 189 | 36 | 286 |
| | I | 0.013 | 0.009 | 14.5 | 0.48 | <0.02 | <0.02 | <0.02 | 0.84 | 0.49 | 0.042 | 21.8 | 15.25 | 190 | 37 | 306 |
| | J | 0.009 | 0.011 | 14.6 | 0.49 | <0.02 | <0.02 | <0.02 | 0.85 | 0.52 | 0.058 | 24.5 | 14.69 | 173 | 37 | 302 |
| | K | 0.011 | 0.008 | 14.9 | 0.41 | <0.02 | <0.02 | <0.02 | 0.88 | 0.50 | 0.065 | 21.6 | 14.48 | 179 | 36 | 298 |
| | L | 0.013 | 0.014 | 14.2 | 0.44 | <0.02 | <0.02 | <0.02 | 0.83 | 0.50 | 0.078 | 16.3 | 12.70 | 125 | 34 | 301 |
| | M | 0.007 | 0.010 | 14.4 | 0.49 | <0.02 | <0.02 | <0.02 | 0.84 | 0.51 | 0.089 | 28.8 | 13.07 | 98 | 34 | 293 |

TABLE 3-continued

Influence of P upon Toughness of Non-annealed Hot-rolled Sheet, Elongation of Hot-rolled Annealed Sheet and YS

| Symbol | | C | N | Cr | Nb | Ti | Zr | Al | Si | Mn | P | Remark (1) | Remark (2) | E(J/cm$^2$) at 0° C. | El (%) | YS (MPa) |
|---|---|---|---|---|---|---|---|---|---|---|---|---|---|---|---|---|
| Comparative Example Steel | 10 | 0.08 | 0.007 | 14.3 | 0.45 | <0.02 | <0.02 | <0.02 | 0.85 | 0.45 | 0.121* | 30.0 | 11.40 | 55 | 31 | 306 |

*Out of Claimed Range
(1) Nb/(C + N)
(2) Cr + 3Si + 4Nb − 50 (C + N + P) − Mn − Ni − Co + Mo + Cu The mechanism of the observed effect of P has not presently been clarified but can be presumably explained as described below. That is, P acts essentially as an substitutional element to negatively affect workability and toughness. During hot rolling, however, the recovery and recrystallization behaviors of the material greatly affect the characteristics of the hot-rolled annealed sheet. It is thought that P acts to retard the recovery and recrystallization behaviors during hot rolling to such an extent as to prevail over the bad influence that P essentially has as an interstitial element and to sufficiently introduce a strain at the time of hot rolling, whereby the annealed structure is formed as a uniform recrystallized structure. However, this is only a hypothesis and has not been confirmed metallographically.

Tables 4-1 and 4-2 show the elongation of hot-rolled annealed sheets of ferritic steels having various compositions and the workability of welded portions.

When a workability parameter Pa=Cr+3Si+4Nb−50(C+N+P)−Mn−Ni−Co+Mo+Cu is larger than 16.5, the breaking elongation of each steel is less than about 34% and the workability is seriously deteriorated, so that the steel cannot suitably be worked in a hot-rolled annealed condition to form a member in a motor vehicle exhaust system. On the other hand, when Pa is smaller than 11, the workability of the welded portions is deteriorated.

Figure 5B:
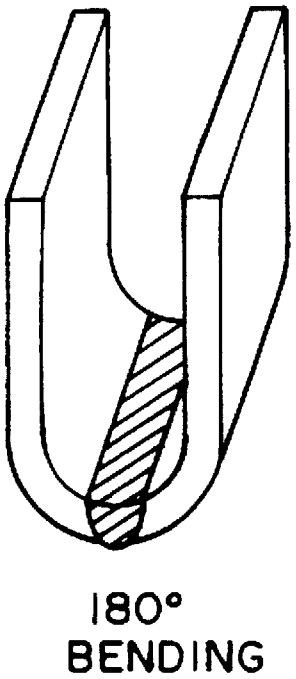
FIGS. 5A and 5B are perspective views of a TIG welding condition and a 180° bending test for evaluating weldability.
Figure 5A:
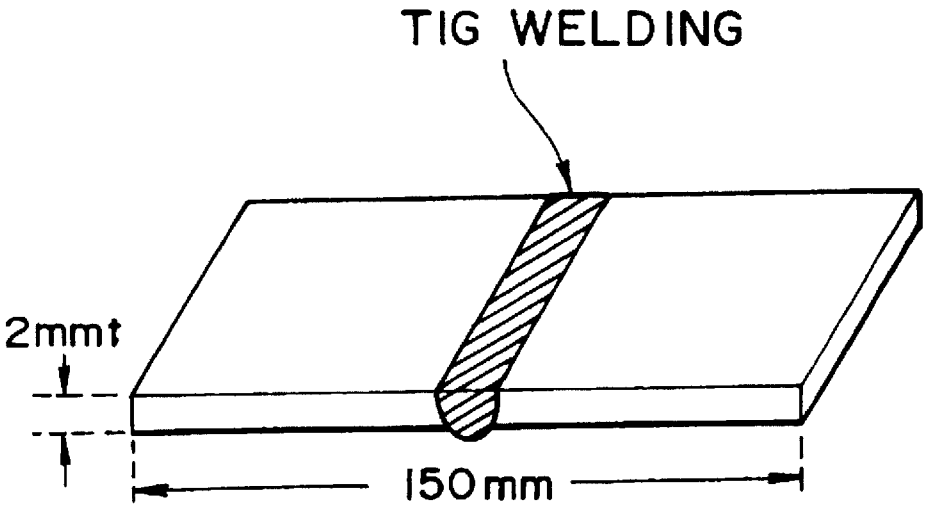

The welded portion workability was evaluated as described below. Each of samples having a shape such as shown in FIG. 5A was welded in a butt-TIG welding manner, as shown in FIG. 5A, under the following conditions: a welding speed of 600 mm/min., and a welding current of 200 A with its one surface sealed with Ar at 15 l/min. The samples were tested as to whether they could be bent through 180° without breaking, as shown in FIG. 5B, and the results are shown in Table 4-1 and 4-2.

Figure 2:
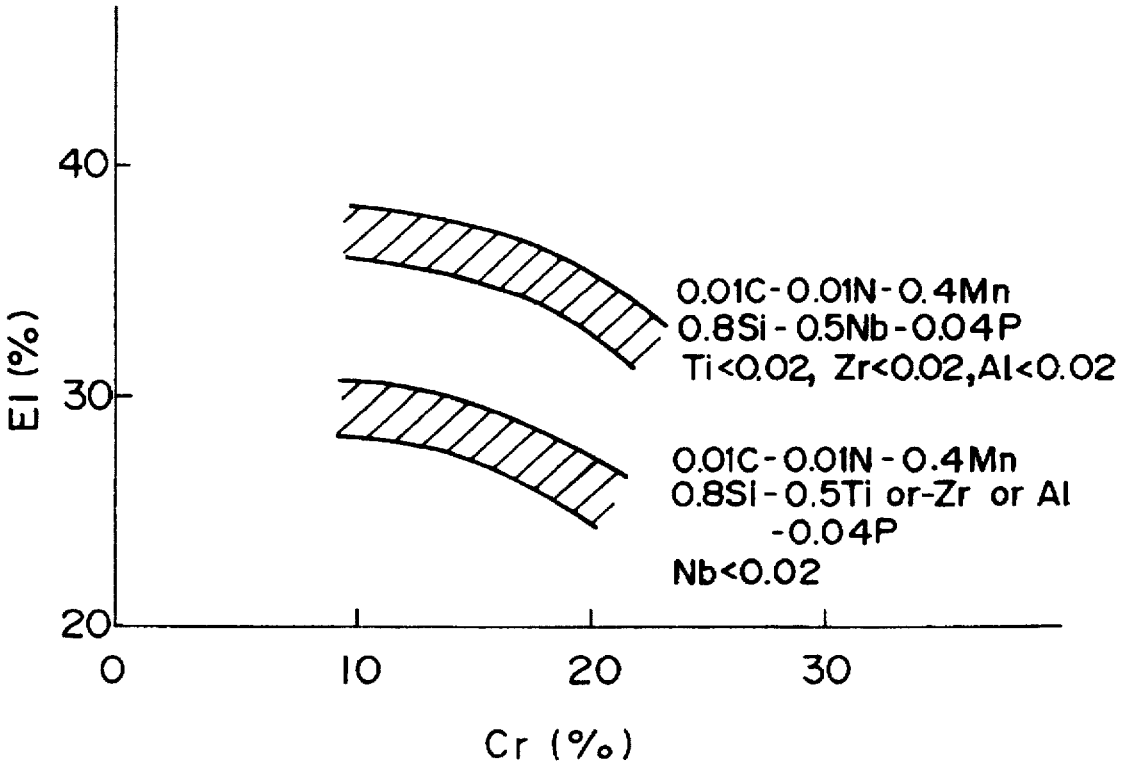
FIG. 2 is a graph showing the influence of Cr upon the elongation of hot-rolled annealed sheets.

FIG. 2 shows the influence of the amount of Cr upon the workability of hot-rolled annealed sheets. The elongation of each of Ti-, Zr-, Al-added steels and Nb-added steel is improved if the amount of Cr is reduced. In the case of each of Ti-, Zr-, and Al-added steels, however, the elongation is at most about 30% when the amount of Cr is reduced to about 10%. The elongation achieved is much smaller than the target value of about 34%. On the other hand, in the case of Nb-added steel, the target value of about 34% can be achieved if the amount of Cr is not larger than about 17%.

Table 5 shows the influence of N and Nb upon solidification cracking in a welded portion. It can be understood that no solidification cracking occurs when the content of N is not larger than about 0.015% and when the content of Nb is not larger than about 0.6%.

TABLE 5

Influence of N, Nb upon Solidification Cracking in TIG-welded Portion

| Symbol | | C | N | Cr | Nb | Ti | Zr | Al | Si | Mn | Mo | Cu | P | Remarks (1) | Remarks (2) | Existence/Non-Existence of Solidification Crack |
|---|---|---|---|---|---|---|---|---|---|---|---|---|---|---|---|---|
| Example Steel of the Invention | Q | 0.006 | 0.007 | 11.4 | 0.51 | <0.02 | <0.02 | <0.02 | 0.82 | 0.35 | 1.12 | — | 0.045 | 39.2 | 12.65 | Not Cracked |
| | I | 0.013 | 0.009 | 14.5 | 0.48 | <0.02 | <0.02 | <0.02 | 0.84 | 0.49 | — | — | 0.042 | 21.8 | 15.25 | Not cracked |
| | L | 0.013 | 0.014 | 14.2 | 0.44 | <0.02 | <0.02 | <0.02 | 0.83 | 0.50 | — | — | 0.078 | 16.3 | 12.70 | Not cracked |
| | F | 0.006 | 0.005 | 14.8 | 0.57 | <0.02 | <0.02 | <0.02 | 0.81 | 0.61 | — | — | 0.041 | 51.8 | 16.30 | Not cracked |
| | V | 0.011 | 0.013 | 15.7 | 0.48 | <0.02 | <0.02 | <0.02 | 0.67 | 0.40 | — | 0.31 | 0.061 | 20.0 | 15.29 | Not cracked |
| | Z | 0.013 | 0.010 | 11.4 | 0.42 | <0.02 | <0.02 | <0.02 | 0.81 | 0.05 | 0.51 | 0.41 | 0.051 | 18.3 | 12.68 | Not cracked |
| Comparative Example Steel | 6 | 0.005 | 0.005 | 14.2 | 0.69* | <0.02 | <0.02 | <0.02 | 0.75 | 0.60 | — | — | 0.031 | 69.0 | 16.56* | Cracked |
| | 7 | 0.019 | 0.010 | 14.3 | 0.72* | <0.02 | <0.02 | <0.02 | 0.83 | 0.55 | — | — | 0.029 | 24.8 | 16.22 | Cracked |
| | 19 | 0.010 | 0.021* | 14.1 | 0.51 | <0.02 | <0.02 | <0.02 | 0.80 | 0.50 | — | — | 0.049 | 16.5 | 14.04 | Cracked |
| | 20 | 0.017 | 0.025* | 16.0 | 0.66* | <0.02 | <0.02 | <0.02 | 0.33 | 0.32 | — | — | 0.034 | 15.7 | 15.51 | Cracked |

*Out of Claimed Range
(1) Nb/(C + N)
(2) Cr + 3Si + 4Nb − 50 (C + N + P) − Mn − Ni − Co + Mo + Cu (2) Table 6 shows the results of high-temperature proof stress measurements of hot-rolled annealed sheets. The high-temperature proof stress at 700° C. of the Nb-added steels in accordance with the present invention is at least twice those of the Ti-, Zr-, and Al-added steels and presently-used SUH409L. Similarly, the high-temperature proof stress at 900° C. is about two-times higher.

TABLE 6

High-temperature Proof Stress of Hot-rolled Annealed Sheet of Steel of the Invention and Comparative Example Steel

| Symbol | | C | N | Cr | Ti | Zr | Al | Si | Mn | Nb | P | Mo | Cu | Remarks (1) | Remarks (2) | 700° C. | 900° C. |
|---|---|---|---|---|---|---|---|---|---|---|---|---|---|---|---|---|---|
| Steel of the Invention | O | 0.003 | 0.004 | 6.3 | 0.015 | 0.011 | 0.006 | 1.94 | 0.31 | 0.51 | 0.044 | — | — | 72.9 | 11.30 | 100 | 19 |
| | N | 0.005 | 0.004 | 6.2 | 0.005 | 0.011 | 0.005 | 1.55 | 0.35 | 0.45 | 0.043 | 2.03 | — | 50.0 | 11.73 | 118 | 23 |
| | P | 0.007 | 0.011 | 9.5 | 0.005 | 0.005 | 0.004 | 1.03 | 0.35 | 0.54 | 0.040 | — | — | 30.0 | 11.50 | 103 | 19 |
| | D | 0.011 | 0.013 | 14.0 | 0.003 | 0.005 | 0.006 | 0.85 | 0.05 | 0.42 | 0.033 | — | — | 17.5 | 15.33 | 93 | 18 |
| | F | 0.006 | 0.005 | 14.8 | 0.004 | 0.004 | 0.008 | 0.81 | 0.61 | 0.57 | 0.041 | — | — | 51.8 | 16.30 | 119 | 20 |
| | V | 0.011 | 0.013 | 15.7 | 0.003 | 0.004 | 0.005 | 0.67 | 0.40 | 0.48 | 0.061 | — | 0.31 | 20.0 | 15.29 | 105 | 20 |
| Comparative Example Steel | SUH409L | 0.006 | 0.007 | 11.3 | 0.25* | 0.005 | 0.019 | 0.35 | 0.51 | —* | 0.023 | — | — | —* | 10.04* | 35 | 11 |
| | 21 | 0.009 | 0.012 | 15.3 | 0.53* | 0.011 | 0.021 | 0.81 | 0.51 | —* | 0.041 | — | — | —* | 14.12 | 35 | 12 |
| | 22 | 0.007 | 0.013 | 14.7 | 0.005 | 0.47* | 0.006 | 0.81 | 0.49 | —* | 0.041 | — | — | —* | 13.59 | 41 | 12 |
| | 23 | 0.008 | 0.009 | 14.8 | 0.031 | 0.021 | 0.43* | 0.83 | 0.51 | —* | 0.040 | — | — | —* | 13.93 | 27 | 9 |
| | 24 | 0.011 | 0.010 | 14.1 | 0.015 | 0.021 | 0.019 | 0.89 | 0.51 | 0.15* | 0.045 | — | — | 7.1* | 13.56 | 42 | 11 |
| | 25 | 0.013 | 0.013 | 14.2 | 0.003 | 0.011 | 0.007 | 0.85 | 0.49 | 0.29* | 0.046 | — | — | 11.2* | 13.82 | 63 | 13 |

*Out of Claimed Range
(1) Nb/(C + N)
(2) Cr + 3Si + 4Nb − 50 (C + N + P) − Mn − Ni − Co + Mo + Cu (3) Table 7 shows the results of oxidation resistance measurements of hot-rolled annealed sheets. Steels of each composition were maintained at temperatures of 730°, 830° and 930° C. for 200 hours, the states of the surfaces were observed. The occurrence of scale nodules mainly formed of an Fe oxide was considered abnormal oxidation. While abnormal oxidation was observed after standing at 830° C. for 200 hours with respect to the presently-used SUH409L, no abnormal oxidation was observed even during standing at 930° C. for 20 hours in atmospheric air with respect to the steels of the invention. It was thereby confirmed that each steel of the present invention has excellent oxidation resistance.

TABLE 7

Oxidation Resistance of Hot-rolled Annealed Sheet of Steel of the Invention and Cold-rolled Annealed Sheet (SUH409L)

| Symbol | | C | N | Cr | Ti | Zr | Al | Si | Mn | Nb | P | Mo | Remarks (1) | Remarks (2) | 730° C. ** | 830° C. ** | 930° C. ** |
|---|---|---|---|---|---|---|---|---|---|---|---|---|---|---|---|---|---|
| SUH409L | | 0.006 | 0.007 | 11.3 | 0.25* | 0.005 | 0.019 | 0.35 | 0.51 | —* | 0.023 | — | —* | 10.04* | ○ | x | x |
| Steel of the Invention | N | 0.005 | 0.004 | 6.2 | 0.005 | 0.011 | 0.005 | 1.55 | 0.35 | 0.45 | 0.043 | 2.03 | 50.0 | 11.73 | ○ | ○ | ○ |
| | L | 0.013 | 0.014 | 14.2 | <0.02 | <0.02 | <0.02 | 0.83 | 0.50 | 0.44 | 0.078 | — | 16.3 | 12.70 | ○ | ○ | ○ |

*Out of Claimed Range
**External Appearance after 200 Hours
○ . . . No abnormal
x . . . Abnormal Oxidation
(1) Nb/(C + N)
(2) Cr + 3Si + 4Nb − 50 (C + N + P) − Mn − Ni − Co + Mo + Cu As a result of the above-described examination, it has been confirmed that a low-priced, hot-rolled ferritic steel having high workability and suitable as a motor vehicle exhaust system material can be obtained even in a hot-rolled annealed condition by using the conventional manufacturing process only if the amount of Nb added, the content of P, the reduction in the content of Cr and the contents of other constituents are well balanced.

In other words, the invention provides a low-priced, hot-rolled ferritic steel for use as a motor vehicle exhaust system material which has heat resistance much higher than that of the presently-used SUH409L. The invention also has high workability, which allows working by conventional hot rolling processes, and can be manufactured at a much lower cost in comparison with the presently-used steel. The reasons for controlling the contents of chemical components in the steel of the invention will now be described.

C acts to deteriorate the stability, workability and oxidation resistance of the ferritic phase. Therefore, the upper limit of the content C is set to about 0.02%, more preferably, about 0.01% or less and, most preferably, about 0.006% or less.

Si is effective in improving the oxidation resistance and high-temperature salt damage resistance as well as stabilizing the ferritic phase. At least about 0.4% of Si is required in the above-mentioned application. Preferably, as shown in Table 8, the content of Si is set to about 0.6% or more to improve the high-temperature salt damage resistance. A method of evaluating the high-temperature salt damage resistance will be described with reference to Examples of the invention. Si also acts to increase the yield stress at room temperature. However, the reduction in elongation is small when the Si content is not larger than about 1%. If the Si content is larger than about 1%, the reduction in elongation becomes substantially large. If the Si content is larger than about 2%, the reduction in elongation and the increase in the yield stress are considerably increased. Accordingly, the Si content is set within the range of about 0.4 to 2% and, more preferably, within the range of about 0.8 to 1.3%.

TABLE 8

Influence of Si upon High-temperature Salt Damage Resistance

| Symbol | | C | N | Cr | Ti | Zr | Al | Si | Mn | Nb | P | Mo | Cu | Remarks (1) | Remarks (2) | Maximum Eroded Depth (μm) | Sample (**) |
|---|---|---|---|---|---|---|---|---|---|---|---|---|---|---|---|---|---|
| SUH409L | | 0.006 | 0.007 | 11.3 | 0.25* | 0.005 | 0.019 | 0.35 | 0.51 | —* | 0.023 | — | — | —* | 10.04* | 193 | C |
| | | | | | | | | | | | | | | | | 201 | H |
| Steel of the Invention | X | 0.005 | 0.005 | 11.4 | <0.004 | 0.005 | <0.004 | 0.45 | 0.08 | 0.52 | 0.042 | — | — | 49.0 | 12.57 | 149 | H |
| | U | 0.013 | 0.013 | 11.7 | <0.004 | 0.005 | <0.004 | 0.63 | 0.08 | 0.49 | 0.047 | — | — | 18.8 | 11.82 | 149 | |
| | T | 0.006 | 0.008 | 11.5 | <0.004 | <0.004 | <0.004 | 0.85 | 0.04 | 0.51 | 0.051 | — | — | 36.4 | 12.80 | 121 | |
| | O | 0.003 | 0.004 | 6.3 | 0.015 | 0.011 | 0.006 | 1.94 | 0.31 | 0.51 | 0.044 | — | — | 72.9 | 11.30 | 84 | |
| | N | 0.005 | 0.004 | 6.2 | 0.005 | 0.011 | 0.005 | 1.55 | 0.35 | 0.45 | 0.043 | 2.03 | — | 5.0 | 11.73 | 68 | |
| | V | 0.011 | 0.013 | 15.7 | 0.003 | 0.004 | 0.005 | 0.67 | 0.40 | 0.48 | 0.061 | — | 0.31 | 20.0 | 15.29 | 101 | |
| | Z | 0.013 | 0.010 | 11.4 | <0.004 | <0.004 | <0.004 | 0.81 | 0.05 | 0.42 | 0.051 | 0.51 | 0.41 | 18.3 | 12.68 | 85 | |

*Out of Claimed Range
**C: Cold-rolled Annealed Sheet
**H: Hot-rolled Annealed sheet
(1) Nb/(C + N)
(2) Cr + 3Sbi + 4Nb − 50 (C + N + P) − Mn − Ni − Co + Mo + Cu Mn negatively affects the stability, oxidation resistance and workability of the ferritic phase. However, the negative effects of Mn are negligible in the above-mentioned application if the Mn content is not larger than about 0.8%. Preferably, the Mn content is limited to about 0.1% or less to obtain high workability. Most preferably, the Mn content is about 0.05% or less.

Cr is necessary for maintaining the desired oxidation resistance. If the Cr content is smaller than about 6%, the workability and oxidation resistance required in the above-mentioned application cannot be achieved even if the contents of other elements are optimized. Conversely, if the Cr content is larger than about 17%, the reduction in workability is considerable, as shown in FIG. 2, and the manufacturing cost is also increased. Therefore, the Cr content is limited within the range of about 6 to 17%. It is desirable to control the Cr content within the range of about 10 to 15% if improvement in workability is particularly important.

More preferably, the Cr content is controlled within the range of about 10 to 12%.

P is one of the important elements according to the invention. It has been typically regarded as an incidental impurity, but it has been discovered that a certain amount of P is desirable with regard to the workability in a hot-rolled annealed condition. If the content of P is about 0.025% or less, the increase in manufacturing cost associated with removing P is large and the workability is deteriorated. If the P content is larger than about 0.10%, the workability is deteriorated while the manufacturing cost is reduced. Accordingly, the P content is set within the range of about 0.025 to 0.10%. Considering workability, it is desirable to set the P content within the range of about 0.03 to 0.07% and, more preferably, within the range of about 0.04 to 0.06%, as shown in Table 3.

It is preferable to reduce the content of N, like in the case of C. In particular, in Nb-containing steel, it is necessary to limit the N content to about 0.015% or less, because N is liable to cause solidification cracking in the welded portion. Preferably, the N content is limited to about 0.010%.

Al negatively affects the workability of hot-rolled annealed steel sheets. Therefore, it is preferable to reduce the Al content to as little as possible. However, reducing Al content to a great extent is unnecessary and increases manufacturing costs. Therefore, the upper limit of the Al content is set to about 0.02% and, more preferably, about 0.005% or less.

The Ti content is also limited to about 0.02% or less for the same reason as given for Al. The Ti content is set preferably to about 0.005% or less and, more preferably, to about 0.001% or less.

The Zr content is also limited to about 0.02% or less for the same reasons given for Al and Ti. The Zr content is set preferably to about 0.005% or less.

Figure 4:
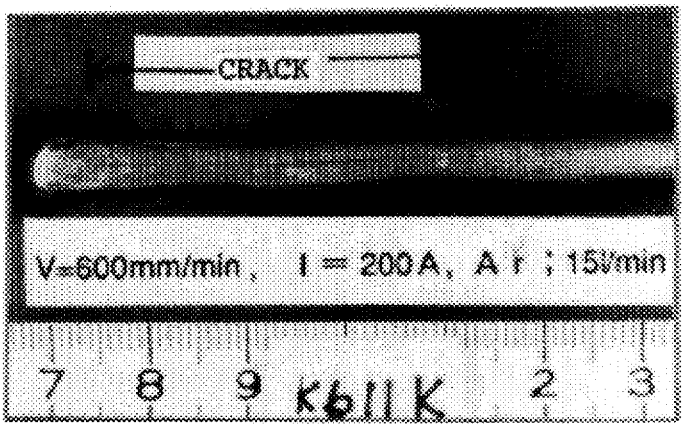
FIG. 4 is a photographic image of a metallographic structure showing an example of a solidification crack in a TIG-welded portion.

Nb is one of the important elements according to the invention. To achieve sufficiently high workability of hot-rolled annealed sheets, Nb must be singly added as a stabilizing element, as shown in FIG. 1. Other stabilizing elements such as Ti, Zr and Al have no effect regarding improving the workability of hot-rolled annealed sheets, although they do improve the workability of cold-rolled annealed sheets. Further, if Ti, Zr and Al are added in combination to the Nb-added steel, the effect of the separate addition of Nb is reduced, as shown in Table 1. Accordingly, for an improvement in workability of hot-rolled annealed sheets, the contents of Ti, Zr and Al are reduced to as little as possible while the content of Nb is set to more than 13 times the content of (C+N). Simultaneously, the Nb content is set to about 0.35% or larger in order to improve the high-temperature proof stress. Conversely, if the Nb content is larger than about 0.6%, workability is reduced and the toughness is considerably reduced, as shown in Table 2. Also, solidification cracking occurs in the welded portion, as shown in Table 5. Accordingly, the upper limit of the Nb content is about 0.6%. The Nb content is preferably set within the range of about 0.40 to 0.55% and, more preferably, within the range of about 0.45 to 0.50%. FIG. 4 shows an example of a solidification crack in Comparative Example Steel 20.

If the workability parameter (Pa) in the equation (2) is smaller than about 11, two phases are formed in the welded portion and the workability thereof is deteriorated, as shown in Table 4. On the other hand, if the workability parameter is larger than about 16.5, the workability is considerably reduced such that the workability of the hot-rolled annealed sheets cannot be high enough for use as a motor vehicle exhaust system material even if the contents of Nb and P are optimized. Accordingly, the workability parameter (Pa) is set within the range of about 11 to 16.5. Preferably, it is within the range of about 13 to 15.5.

$$Pa=Cr+3Si+4Nb-50(C+N+P)-Mn-Ni-Co+Mo+Cu \quad (2)$$

where the symbol of each element represents the weight percentage of the content of the element. Each of the Ni, Co, Mo and Cu contents may be considered only when each is added to the steel.

The reason for limiting these selected elements will now be described.

Mo and Cu may be added to improve the high-temperature proof stress and the high-temperature salt damage resistance. The beneficial effect of this addition can be observed when each of Mo and Cu contents is about 0.1% or more. However, because these elements are expensive, the upper limit of the Mo content is about 3% and the upper limit of the Cu content is about 1%. Preferably, the Mo content and the Cu content are within the range of about 0.5 to 2.5% and about 0.3 to 0.6%, respectively. More preferably, the Mo content and the Cu content are within the range of about 1.0 to 1.5% and about 0.4 to 0.6%, respectively.

Each of Ni and Co improves the toughness of a welded portion. Table 9 shows the effects of these elements, measured under the same welding condition as the measurements performed for Table 4. Since Ni and Co are expensive elements, the upper limit of the Ni content is about 1% and the upper limit of the Co content is about 0.5%. These elements are equivalent in their effect; therefore, they may be added singly or in combination. Preferably, the Ni content is about 0.5% or less and the Co content is about 0.2% or less.

(SRT) to 1250° C. Various characteristics of the steel sheets obtained in this manner were examined, as described below.

Charpy impact characteristics at 0° C. of test pieces notched in a direction perpendicular to the rolling direction were examined.

The elongation in the rolling direction at room temperature, the yield stress and high-temperature proof stress at 700° and 900° C. were measured with respect to materials which were prepared by annealing the Nb containing steels at 980° C. and by annealing the Non-Nb-added steels at 930° C. so that the grain size was generally uniform. The high-temperature proof stress was measured at a strain rate of 0.3%/min.

To evaluate oxidation resistance, changes in weight after an oxidation test at 730°, 830° and 930° C. for 200 hours in atmospheric air were measured.

To evaluate high-temperature salt damage resistance, 2 mm thick×2 mm wide×30 mm long members were immersed in a saturated sodium chloride water solution for 5 minutes, thereafter heated at 700° C. for 2 hours and cooled by 10 cycles of air cooling with a period of five minutes, and the maximum eroded depth was measured.

A weldability test of each hot-rolled annealed sheet was performed such that each steel sheet was welded by TIG welding, then the existence/non-existence of solidification cracking, bending characteristics and a Charpy impact characteristics of the TIG-welded portion were observed.

TABLE 9

Influence of Ni, Co upon Toughness of TIG-welded Portion (Steel of the Invention)

| Symbol | C | H | Cr | Ti | Zr | Al | Si | Mn | Nb | P | Ni | Co | Mo | Cu | Remarks (1) | Remarks (2) | Absorbed Energy in Welded Portion (J/cm² at 0° C.) | Elongation of Hot-rolled Annealed Sheet (%) |
|---|---|---|---|---|---|---|---|---|---|---|---|---|---|---|---|---|---|---|
| F | 0.006 | 0.005 | 14.8 | <0.02 | <0.02 | <0.02 | 0.81 | 0.61 | 0.57 | 0.041 | — | — | — | — | 51.8 | 15.73 | 69 | 37 |
| FA | 0.011 | 0.007 | 14.5 | <0.02 | <0.02 | <0.02 | 0.85 | 0.59 | 0.55 | 0.043 | 0.45 | — | — | — | 30.6 | 14.61 | 103 | 37 |
| FB | 0.005 | 0.012 | 14.1 | <0.02 | <0.02 | <0.02 | 0.79 | 0.60 | 0.55 | 0.040 | — | 0.07 | — | — | 32.4 | 14.60 | 95 | 37 |
| R | 0.005 | 0.005 | 11.9 | <0.02 | <0.02 | <0.02 | 1.02 | 0.31 | 0.55 | 0.050 | — | — | 0.52 | — | 55.0 | 13.82 | 85 | 38 |
| RA | 0.007 | 0.012 | 12.1 | <0.02 | <0.02 | <0.02 | 1.11 | 0.33 | 0.50 | 0.045 | 0.31 | 0.13 | 0.55 | — | 26.3 | 13.51 | 127 | 37 |
| W | 0.005 | 0.009 | 12.5 | <0.02 | <0.02 | <0.02 | 0.85 | 0.05 | 0.48 | 0.051 | 0.22 | 0.05 | 0.50 | — | 34.3 | 13.72 | 139 | 39 |
| V | 0.011 | 0.013 | 15.7 | <0.02 | <0.02 | <0.02 | 0.67 | 0.40 | 0.48 | 0.061 | — | — | — | 0.31 | 20.0 | 15.29 | 70 | 37 |
| VA | 0.007 | 0.009 | 15.5 | <0.02 | <0.02 | <0.02 | 0.71 | 0.41 | 0.49 | 0.053 | 0.83 | — | — | 0.33 | 30.6 | 15.23 | 131 | 38 |
| Z | 0.013 | 0.010 | 11.4 | <0.02 | <0.02 | <0.02 | 0.81 | 0.05 | 0.42 | 0.051 | — | — | 0.51 | 0.41 | 18.3 | 12.68 | 90 | 37 |
| ZA | 0.012 | 0.009 | 11.7 | <0.02 | <0.02 | <0.02 | 0.83 | 0.09 | 0.45 | 0.051 | 0.29 | 0.06 | 0.41 | 0.44 | 21.4 | 12.80 | 145 | 37 |

(1) Nb/(C + N)
(2) Cr + 3Si + 4Nb − 50 (C + N + P) − Mn − Ni − Co + Mo + Cu

EXAMPLES

The invention will be illustrated through specific Examples described below. The Examples are not intended to limit the scope of the invention defined in the appended claims.

Steels having compositions as shown in Tables 1 to 9 (steels of the invention, comparative example steels, presently-used steel SUH409L) were each melted in a vacuum smelting furnace to form an ingot having a weight of 30 kg. The ingot was hot-forged into a sheet having a thickness of 27 mm and was thereafter hot rolled to a thickness of 2 mm by setting the slab reheating temperature As shown in Tables 1 to 9, each of the steels of the present invention had characteristics necessary for use as a motor vehicle exhaust system material, as described below.

(1) Charpy absorbed energy of the non-annealed hot-rolled sheet at 0C: about 50 J/cm² or more
(2) Elongation, YS of the hot-rolled annealed sheet: about 34% or more, 350 MPa or less
(3) TIG welded characteristic of the hot-rolled annealed sheet: no solidification crack, bendable through 180°
(4) High-temperature proof stress at 700° C. of the hot-rolled annealed sheet: at least about twice that of SUH409L
High-temperature proof stress at 900° C. of the hot-rolled annealed sheet: about twice that of SUH409L (5) Oxidation resistance of the hot-rolled annealed sheet after testing at 930° for 200 hours: no abnormal oxidation (Abnormal oxidation was observed with respect to the cold-rolled annealed sheet of the presently-used steel SUH409L after testing at 830° for 200 hours.)

(6) High-temperature salt damage resistance at 700° C.: much higher than that of SUH409L In each of the comparative example steels shown in Tables 1 to 9, the content of at least one constituent is out of the range of the invention, and one or more of the above-mentioned characteristics (1) to (6) are not achieved. Therefore, it is difficult to apply the comparative example steels in a hot-rolled annealed condition as a motor vehicle exhaust system material.

As described above, according to the invention, it is possible to obtain, even by using a conventional hot rolling process, a low-priced hot-rolled material for a motor vehicle exhaust system having high workability, high heat resistance and good manufacturability. If this hot-rolled material is applied to a member in a motor vehicle exhaust system, improved engine performance, energy savings and pollution reduction can be achieved. Thus, the invention is very useful in the industry.

According to the present invention, the hot-rolled sheet is recrystallization-annealed before being used as a motor vehicle exhaust system material. If the hot-rolled sheet is worked into a pipe, the recrystallization annealing step may be performed before or after the working required to form the pipe.

Testing for the high-temperature characteristic evaluation in accordance with the invention is performed at temperatures from 700° to 930° C. However, the present invention is not limited to members heated to such temperatures. The invention can be well applied to members of a motor vehicle exhaust system heated at other temperatures, e.g., a muffler heated to a maximum of about 500° C.

Although this invention has been described with reference to specific compositions, various other compositions may be included that are within the spirit and scope of the invention defined in the appended claims.

What is claimed is:

1. A hot-rolled but not cold-rolled ferritic steel containing:

about 0.02 wt % or less of C, about 0.8 wt % or less of Mn, about 0.015 wt % or less of N, about 0.02 wt % or less of Al, about 0.02 wt % or less of Ti, about 0.02 wt % or less of Zr;

said steel essentially comprising:

about 0.4 to 2 wt % of Si, about 6 to 17 wt % of Cr, about 0.025 to 0.10 wt % of P, about 0.35 to 0.60 wt % of Nb; and the balance Fe and incidental impurities, wherein the weight percentages of said components satisfy the following equations (1) and (2):

$$Nb/(C+N) \geqq 13 \quad (1)$$

$$11 \leqq Cr+3Si+4Nb-50(C+N+P)-Mn-Ni-Co+Mo+Cu \leqq 16.5 \quad (2),$$

whereby a low-cost hot-rolled ferritic steel is produced which, after conventional hot rolling, annealing and cooling, and without cold rolling, exhibits characteristics for motor vehicle exhaust systems such as high workability, high heat resistance and good manufacturability.

2. A hot-rolled but not cold-rolled ferritic steel containing:

about 0.02 wt % or less of C, about 0.8 wt % or less of Mn, about 0.015 wt % or less of N, about 0.02 wt % or less of Al, about 0.02 wt % or less of Ti, about 0.02 wt % or less of Zr;

said steel essentially comprising:

about 0.4 to 2 wt % of Si, about 6 to 17 wt % of Cr, about 0.025 to 0.10 wt % of P, about 0.35 to 0.60 wt % of Nb, at least one element selected from the group consisting of about 0.1 to 3.0 wt % of Mo and about 0.1 to 1.0 wt % of Cu; and the balance Fe and incidental impurities, wherein the weight percentages of said components satisfy the following equations (1) and (2):

$$Nb/(C+N) \geqq 13 \quad (1)$$

$$11 \leqq Cr+3Si+4Nb-50(C+N+P)-Mn-Ni-Co+Mo+Cu \leqq 16.5 \quad (2),$$

whereby a low-cost ferritic steel is produced which, after conventional hot rolling, annealing and cooling, and without cold rolling, exhibits characteristics for motor vehicle exhaust systems such as high workability, high heat resistance and good manufacturability.

3. A hot-rolled but not cold-rolled ferritic steel, said hot-rolled ferritic steel being used in the absence of cold rolling and containing:

about 0.02 wt % or less of C, about 0.8 wt % or less of Mn, about 0.015 wt % or less of N, about 0.02 wt % or less of Al, about 0.02 wt % or less of Ti, about 0.02 wt % or less of Zr;

said steel essentially comprising:

about 0.4 to 2 wt % of Si, about 6 to 17 wt % of Cr, about 0.025 to 0.10 wt % of P, about 0.35 to 0.60 wt % of Nb, at least one element selected from the group consisting of about 1 wt % or less of Ni and about 0.5 wt % or less of Co; and the balance Fe and incidental impurities, wherein the weight percentages of said components satisfy the following equations (1) and (2):

$$Nb/(C+N) \geqq 13 \quad (1)$$

$$11 \leqq Cr+3Si+4Nb-50(C+N+P)-Mn-Ni-Co+Mo+Cu \leqq 16.5 \quad (2),$$

whereby a low-cost ferritic steel is produced which, after conventional hot rolling, annealing and cooling, and without cold rolling, exhibits characteristics for motor vehicle exhaust systems such as high workability, high heat resistance and good manufacturability.

4. A hot-rolled but not cold-rolled ferritic steel containing:

about 0.02 wt % or less of C, about 0.8 wt % or less of Mn, about 0.015 wt % or less of N, about 0.02 wt % or less of Al, about 0.02 wt % or less of Ti, about 0.02 wt % or less of Zr;

said steel essentially comprising:

about 0.4 to 2 wt % of Si, about 6 to 17 wt % of Cr, about 0.025 to 0.10 wt % of P, about 0.35 to 0.60 wt % of Nb, at least one element selected from the group consisting of about 0.1 to 3.0 wt % of Mo and about 0.1 to 1.0 wt % of Cu, at least one element selected from the group consisting of about 1 wt % or less of Ni and about 0.5 wt % or less of Co; and the balance Fe and incidental impurities, wherein the weight percentages of said components satisfy the following equations (1) and (2):

$$Nb/(C+N) \geqq 13 \quad (1)$$

$$11 \leqq Cr+3Si+4Nb-50\,(C+N+P)-Mn-Ni-Co+Mo+Cu \leqq 16.5 \quad (2),$$

whereby a low-cost ferritic steel is produced which, after conventional hot rolling, annealing and cooling, and without cold rolling, exhibits characteristics for motor vehicle exhaust systems such as high workability, high heat resistance and good manufacturability.

5. A motor vehicle exhaust manifold comprising a hot-rolled ferritic steel according to claim 1.

6. A motor vehicle exhaust manifold comprising a hot-rolled ferritic steel according to claim 2.

7. A motor vehicle exhaust manifold comprising a hot-rolled ferritic steel according to claim 3.

8. A motor vehicle exhaust manifold comprising a hot-rolled ferritic steel according to claim 4.

9. A motor vehicle exhaust pipe comprising a hot-rolled ferritic steel according to claim 1.

10. A motor vehicle exhaust pipe comprising a hot-rolled ferritic steel according to claim 2.

11. A motor vehicle exhaust pipe comprising a hot-rolled ferritic steel according to claim 3.

12. A motor vehicle exhaust pipe comprising a hot-rolled ferritic steel according to claim 4.

13. A motor vehicle catalytic converter shell comprising a hot-rolled ferritic steel according to claim 1.

14. A motor vehicle catalytic converter shell comprising a hot-rolled ferritic steel according to claim 2.

15. A motor vehicle catalytic converter shell comprising a hot-rolled ferritic steel according to claim 3.

16. A motor vehicle catalytic converter shell comprising a hot-rolled ferritic steel according to claim 4.

17. A ferritic steel sheet comprising a hot-rolled ferritic steel according to claim 1, said steel sheet having a breaking elongation of not less than about 34% at a thickness of 2 mm.

18. A ferritic steel sheet comprising a hot-rolled ferritic steel according to claim 2, said steel sheet having a breaking elongation of not less than about 34% at a thickness of 2 mm.

19. A ferritic steel sheet comprising a hot-rolled ferritic steel according to claim 3, said steel sheet having a breaking elongation of not less than about 34% a thickness of 2 mm.

20. A ferritic steel sheet comprising a hot-rolled ferritic steel according to claim 4, said steel sheet having a breaking elongation of not less than about 34% at a thickness of 2 mm.

* * * * *

UNITED STATES PATENT AND TRADEMARK OFFICE

CERTIFICATE OF CORRECTION

PATENT NO. : 5,792,285

DATED : August 11, 1998

INVENTOR(S) : Atsushi Miyazaki, Takeshi Yokota and Fusao Togashi

It is certified that error appears in the above-indentified patent and that said Letters Patent is hereby corrected as shown below:

Spanning Columns 3 and 4, in Table 4-1, under the Column "Nb", row 3, please change "0.43" to --0.54--.

Spanning Columns 3 and 4, in Table 4-2, under the Column "Bendability", row 8, please change "o" to --x--.

Spanning Columns 15 and 16, in Table 8, under the Column "(1)", row 7, please change "5.0" to --50.0--; and under the Column "(**)", rows 4-9, please insert "H".

Spanning Columns 17 and 18, in Table 9, in the third Column from the left, please change "H" to --N-- in the column heading.

Signed and Sealed this

Thirteenth Day of April, 1999

*Attest:*

Q. TODD DICKINSON

*Attesting Officer*

*Acting Commissioner of Patents and Trademarks*